US008177415B1

(12) United States Patent
White

(10) Patent No.: US 8,177,415 B1
(45) Date of Patent: May 15, 2012

(54) SYSTEM FOR AGITATING POUCHED PRODUCTS

(75) Inventor: Peter J. White, Farmingdale, NY (US)

(73) Assignee: Tarpaulin.com, Inc., Woodbury, NY (US)

( * ) Notice: Subject to any disclaimer, the term of this patent is extended or adjusted under 35 U.S.C. 154(b) by 924 days.

(21) Appl. No.: 11/782,462

(22) Filed: Jul. 24, 2007

Related U.S. Application Data

(60) Provisional application No. 60/832,833, filed on Jul. 24, 2006.

(51) Int. Cl.
*B01F 11/00* (2006.01)

(52) U.S. Cl. ..... 366/197; 366/218; 198/866

(58) Field of Classification Search ..... 100/153; 141/77–79; 366/275, 279, 197–218; 198/866
See application file for complete search history.

(56) References Cited

U.S. PATENT DOCUMENTS

| | | | | | |
|---|---|---|---|---|---|
| 246,731 | A | * | 9/1881 | Davis | 100/74 |
| 417,199 | A | * | 12/1889 | Paine | 101/171 |
| 645,394 | A | * | 3/1900 | Hommel | 100/153 |
| 699,115 | A | * | 4/1902 | Reagan | 100/38 |
| 881,186 | A | * | 3/1908 | Hulings et al. | 100/118 |
| 1,053,184 | A | * | 2/1913 | Kern | 100/72 |
| 1,058,747 | A | * | 4/1913 | Hoepner | 141/78 |
| 1,570,235 | A | | 1/1926 | Fooks | |
| 1,596,606 | A | | 8/1926 | Fooks | |
| 1,845,676 | A | * | 2/1932 | McNamara | 100/153 |
| 1,869,987 | A | * | 8/1932 | Van Denburg | 100/153 |
| 2,336,438 | A | * | 12/1943 | Evans | 366/108 |
| 2,368,945 | A | | 2/1945 | Peebles | |
| 2,373,162 | A | * | 4/1945 | Brechtel | 198/523 |
| 2,380,134 | A | | 7/1945 | Waters | |
| 2,517,542 | A | | 8/1950 | Clifcorn et al. | |
| 2,569,656 | A | | 10/1951 | Chissom et al. | |
| 2,582,872 | A | * | 1/1952 | Krengel | 241/293 |
| 2,816,837 | A | | 12/1957 | Holsman | |
| 3,052,559 | A | | 9/1962 | Peebles | |
| 3,167,304 | A | * | 1/1965 | Lemmond | 366/109 |
| 3,200,560 | A | * | 8/1965 | Randall | 53/86 |
| 3,283,523 | A | | 11/1966 | Long | |
| 3,302,423 | A | | 2/1967 | Morrison | |
| 3,464,835 | A | | 9/1969 | Castro | |
| 3,539,007 | A | * | 11/1970 | Schweiker et al. | 209/634 |
| 3,668,786 | A | * | 6/1972 | Barny | 34/524 |
| 3,669,008 | A | * | 6/1972 | Reist | 100/35 |
| 3,709,650 | A | * | 1/1973 | Gutoski et al. | 425/367 |
| 3,722,833 | A | * | 3/1973 | Inoue et al. | 366/348 |
| 3,732,917 | A | | 5/1973 | Deubel | |
| 3,771,773 | A | * | 11/1973 | Schriever | 366/69 |
| 3,819,158 | A | * | 6/1974 | Sharpe et al. | 366/349 |
| 3,907,473 | A | * | 9/1975 | de Mets | 425/141 |
| 3,968,818 | A | * | 7/1976 | Gerrans | 141/78 |
| 4,218,970 | A | * | 8/1980 | Tutschek et al. | 100/153 |

(Continued)

FOREIGN PATENT DOCUMENTS

JP 54065696 A * 5/1979

(Continued)

*Primary Examiner* — Charles E Cooley
(74) *Attorney, Agent, or Firm* — Hoffman & Baron, LLP

(57) ABSTRACT

A system and method for agitating pouched products traveling along a conveyor belt to facilitate heat transfer, blending, mixing and/or stirring of the contents thereof. An agitation station is located along the conveyor belt, and includes an agitator secured to one end of an arm, the arm being pivotally secured to the frame supporting the conveyor belt.

10 Claims, 6 Drawing Sheets

U.S. PATENT DOCUMENTS

| | | | | | |
|---|---|---|---|---|---|
| 4,384,463 | A | | 5/1983 | Rica et al. | |
| 4,385,035 | A | | 5/1983 | Akitoshi et al. | |
| 4,437,315 | A | | 3/1984 | Rica et al. | |
| 4,505,670 | A | | 3/1985 | Silvestrini et al. | |
| 4,550,653 | A | * | 11/1985 | Hedenberg | 99/348 |
| 4,784,297 | A | * | 11/1988 | Katz | 222/161 |
| 4,907,723 | A | * | 3/1990 | Katz | 222/105 |
| 5,009,150 | A | | 4/1991 | Andersen | |
| 5,161,884 | A | * | 11/1992 | Siminovitch | 362/294 |
| 5,370,174 | A | | 12/1994 | Silvestrini et al. | |
| 5,439,544 | A | * | 8/1995 | Bory | 156/210 |
| 5,699,902 | A | * | 12/1997 | Sperry et al. | 206/219 |
| 5,727,370 | A | | 3/1998 | Sperry | |
| 5,810,259 | A | | 9/1998 | Sinclair | |
| 5,913,603 | A | * | 6/1999 | Sperry et al. | 366/204 |
| 6,142,396 | A | | 11/2000 | Gallus | |
| 6,142,661 | A | * | 11/2000 | Lafond | 366/204 |
| 6,158,335 | A | * | 12/2000 | Safman et al. | 100/47 |
| 6,206,632 | B1 | | 3/2001 | Gallus | |
| 6,267,498 | B1 | * | 7/2001 | Lafond et al. | 366/204 |
| 6,273,600 | B1 | * | 8/2001 | Sharpe | 366/117 |
| 6,301,905 | B1 | | 10/2001 | Gallus | |
| 6,340,449 | B1 | | 1/2002 | Gallus | |
| 6,387,322 | B1 | | 5/2002 | Gallus | |
| 6,416,212 | B1 | * | 7/2002 | Rogers et al. | 366/117 |
| 6,439,759 | B1 | * | 8/2002 | Ray et al. | 366/197 |
| 6,634,783 | B2 | * | 10/2003 | Baron | 366/204 |
| 6,698,504 | B2 | * | 3/2004 | Briesmeister | 165/109.1 |
| 7,077,559 | B2 | * | 7/2006 | Hlavinka et al. | 366/197 |
| 7,377,686 | B2 | * | 5/2008 | Hubbard | 366/208 |
| 7,614,781 | B2 | * | 11/2009 | Esveld et al. | 366/275 |
| 7,789,551 | B2 | * | 9/2010 | Ray et al. | 366/108 |
| 7,891,860 | B2 | * | 2/2011 | Hubbard | 366/208 |
| 7,963,690 | B2 | * | 6/2011 | Thompson et al. | 366/275 |
| 2002/0059872 | A1 | * | 5/2002 | Brox | 100/38 |
| 2003/0031085 | A1 | * | 2/2003 | Baron | 366/144 |
| 2005/0063250 | A1 | * | 3/2005 | Hubbard | 366/275 |
| 2006/0140052 | A1 | * | 6/2006 | Esveld et al. | 366/275 |
| 2011/0080800 | A1 | * | 4/2011 | White | 366/207 |

FOREIGN PATENT DOCUMENTS

| | | | | |
|---|---|---|---|---|
| JP | 57023529 | A | * | 2/1982 |
| SU | 1681937 | A1 | * | 10/1991 |

* cited by examiner

50

SYSTEM FOR AGITATING POUCHED PRODUCTS

This application claims the benefit of U.S. Provisional Application Ser. No. 60/832,833 filed on Jul. 24, 2006.

BACKGROUND OF THE INVENTION

The present invention relates to the agitation of pouched products and, more particularly, to a system and method for agitating pouched products traveling along a conveyor belt to facilitate heat transfer, blending, mixing and/or stirring of the contents thereof.

Those skilled in the art will appreciate that various products are packaged in flexible resilient containers, e.g., pouches made of plastic film or other such flexible materials. These products may include food products such as sauces, soups, juices, gravies, etc. or industrial/medical products including gels and salves. The mentioned pouches, which can take many different shapes, are often times transported along a conveyor belt during the packaging/processing stage. The pouched products may need to be heated as they travel along the conveyor belt (e.g., to effect a pasteurization process), may need to be cooled (e.g., to retard growth of bacteria) or may need to be mixed/stirred for miscellaneous processing purposes.

For example, in a typical food preparation process, a pouch is hot-filled with a food product and thereafter sealed. Once sealed, the pouched product is subjected to a pasteurization process where it is heated to a predetermined temperature for a preselected period of time. The pouched product is then rapidly cooled. This cooling is typically accomplished as the pouch moves along a conveyor belt, e.g., by spraying cold water and/or air onto the pouch. However, because the pouch contains a quantity of heated product, and because the cold water/air contacts only the outer surface of the pouch, it has been difficult in the past to quickly and uniformly cool the entire contents of the pouch. Failure to quickly and uniformly cool the entire contents of the package can result in over-processing and/or deterioration of the quality of the product contained in the pouch.

Available systems attempt to increase the heat transfer rate of the pouched products by "flipping" the pouch from one side to the other as it proceeds down the conveyor belt in an effort to mix the contents of the pouch. This may be accomplished by various mechanical equipment, e.g., a U-shaped slide extending between one section of the conveyor belt and a second section of the conveyor belt. It will be appreciated, however, that "flipping" of the pouches to increase the heat transfer rate has several significant disadvantages, including the potential of breaking or creating leaks in the pouch, wrinkling the pouch and/or marring the printing contained on the pouch. Moreover, the currently available systems have the potential to cause a significant backup in the line in the event that a pouch becomes jammed while being "flipped."

Other prior art systems use basket-like transport to move the packages through a fluid bath or spray while subjecting the package to a rocking motion. However, such systems are complex and difficult to operate. In addition, they do not allow for the ready modification of existing conveyor belts. Still, other known systems immerse the pouched product in a fluid bath while subjecting the pouches to forces such as a wet jet or a vibrating member. Again, these systems are complex, difficult to operate and not suitable for the retrofitting of existing conveyor belts.

There is therefore a need in the art for a system and method which can facilitate heat transfer, blending, mixing and/or stirring of the product contained within a flexible resilient pouch traveling along a conveyor belt. There is a further need in the art for a simple, energy efficient system which allows for the ready modification of existing conveyor belts.

SUMMARY OF THE INVENTION

The present invention, which addresses the needs of the prior art, relates to a system for agitating a pouched product. The system includes a frame. The system further includes a conveyor belt supported by the frame for transporting the pouched product, the conveyor belt defining a pouch pathway. The system additionally includes at least one agitation station located along the conveyor belt for agitating the pouched product traveling therepast. The station includes an agitator and an arm having first and second ends. The first end of the arm is pivotally secured to the frame. The agitator is secured to the second end of the arm. The arm is located to position the agitator adjacent the belt and within the pathway of the pouch whereby movement of the pouch through the agitation station causes the pouch to engage the agitator.

The present invention further relates to a method for agitating pouched products. The method includes the step of providing a frame. The method includes the further step of providing a conveyor belt supported by the frame for transporting the pouched product, the conveyor belt defining a pouch pathway. The method includes the additional step of providing at least one agitation station located along the conveyor belt, the station including an agitator and an arm having first and second ends, the first end of the arm being pivotally secured to the frame, the agitator being secured to the second end of the arm, the arm being located to position the agitator adjacent the belt and within the pathway of the pouch. Finally, the method includes the step of transporting the pouched product along the conveyor belt such that the pouched product travels through the agitation station causing the pouch to engage the agitator whereby the product within the pouch is agitated.

Finally, the present invention relates to a method of retrofitting an existing conveyor belt apparatus to agitate pouches traveling therealong. The apparatus including a conveyor belt supported by a frame, the conveyor belt defining a pouch pathway. The method includes the step of locating an agitation station at a preselected position along the conveyor belt, the station including an agitator and an arm having first and second ends, the first end of the arm being pivotally secured to the frame, the agitator being secured to the second end of the arm, the arm being located to position the agitator adjacent the belt within the pathway of the pouch. The method includes the further step of pivotally securing the first end of the arm to the frame such that the agitator is located at a position adjacent the belt and within the pathway of the pouch.

As a result, the present invention provides both a system and method which can facilitate heat transfer, blending, mixing and/or stirring of the product contained within a flexible resilient pouch traveling along a conveyor belt during a manufacturing/processing procedure. In addition, the present invention provides a simple, energy efficient system which allows for the ready modification of existing conveyor belts without the need to disassemble such existing systems.

DETAILED DESCRIPTION OF THE INVENTION

As discussed further hereinbelow, the present invention relates to a system for agitating pouched products traveling along a conveyor belt to facilitate heat transfer, blending, mixing and/or stirring of the contents thereof. This is accomplished in a system that employs a limited number of parts, is simple to operate and maintain, does not require additional sources of energy and may be easily added to existing conveyor belt systems.

Figure 1:
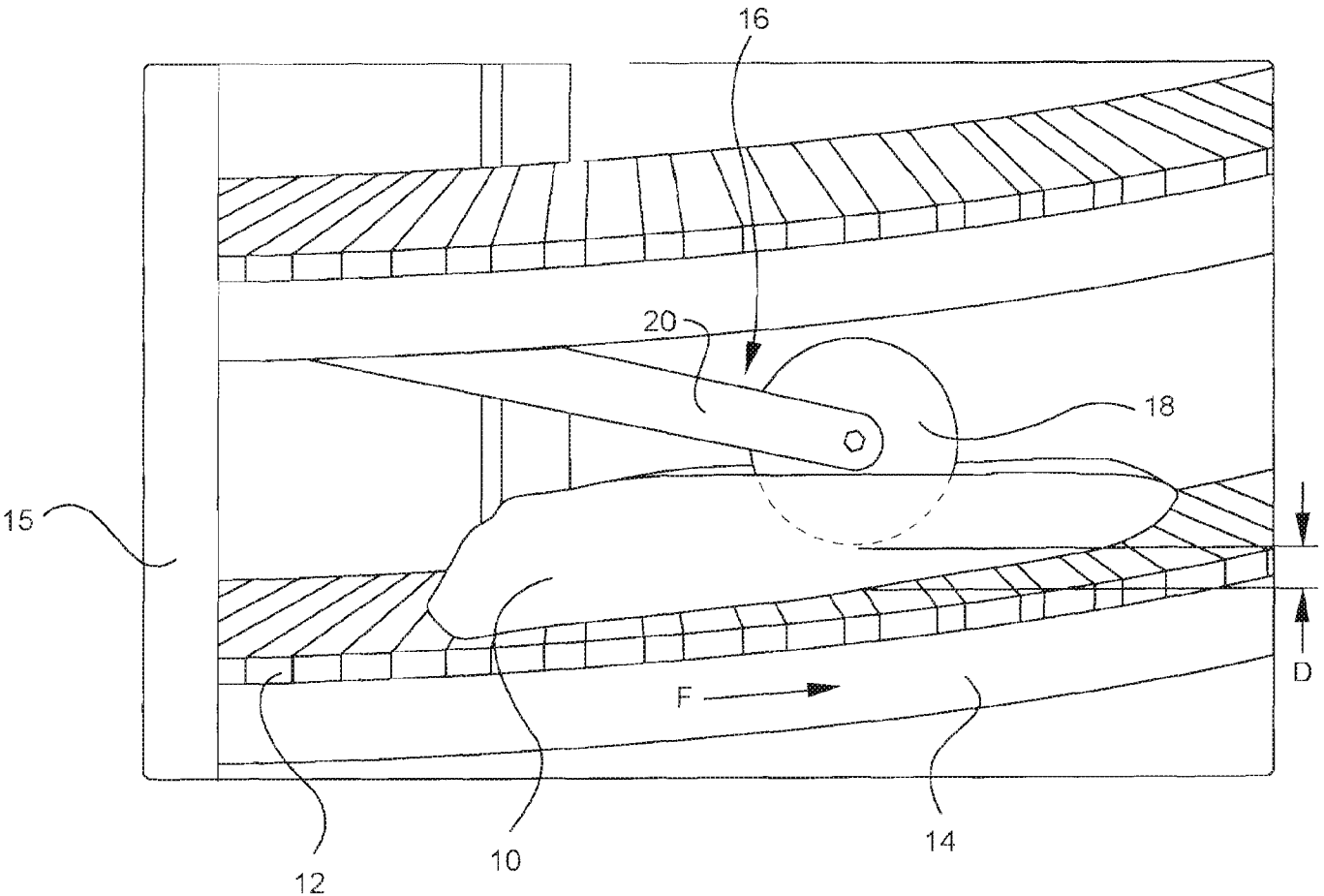
FIG. 1 is a perspective view showing a pouched product in contact with an agitator of the present invention.
Figure 2:
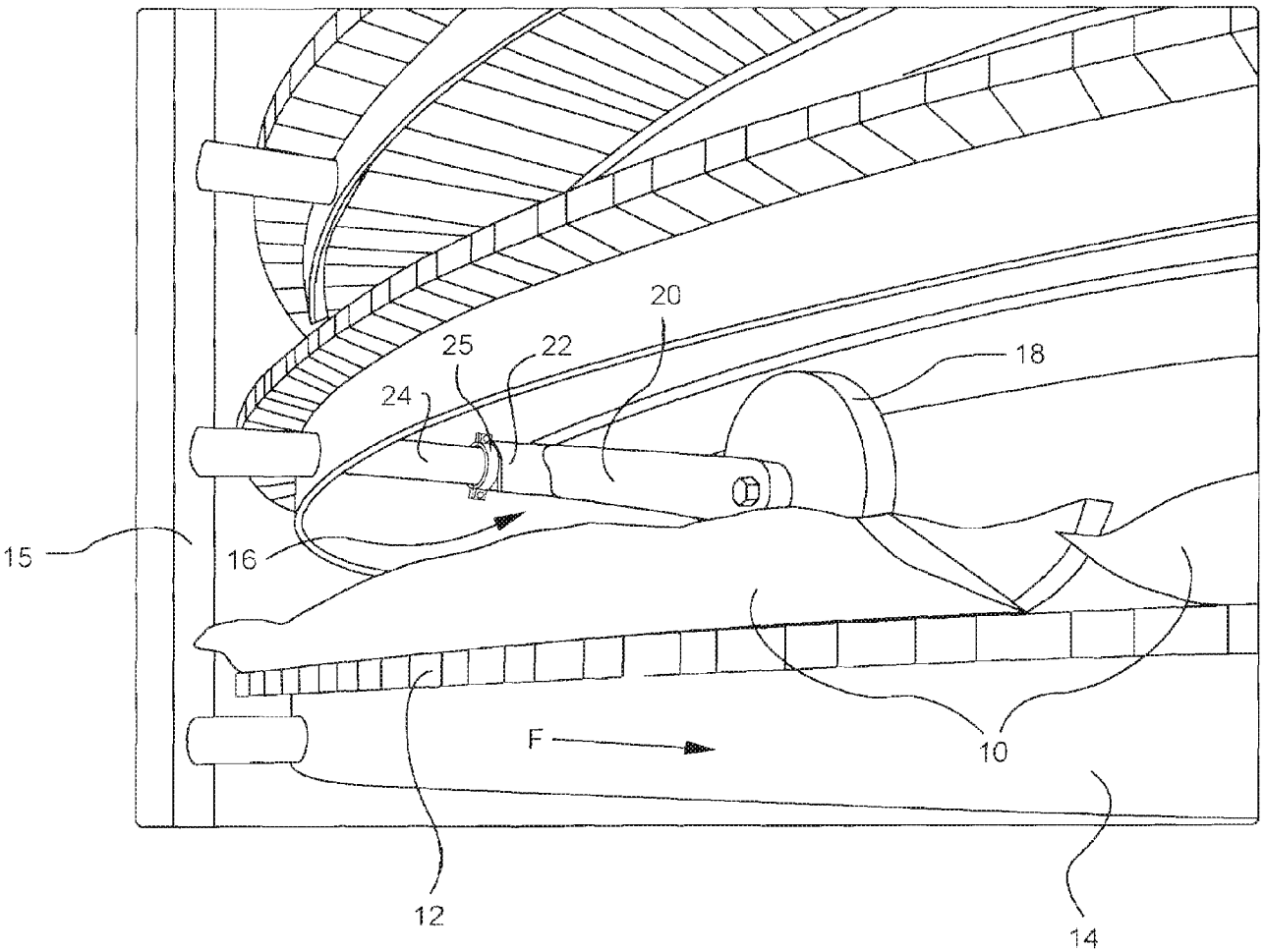
FIG. 2 is another perspective view showing the pouched product in contact with the agitator of FIG. 1.
Figure 3:
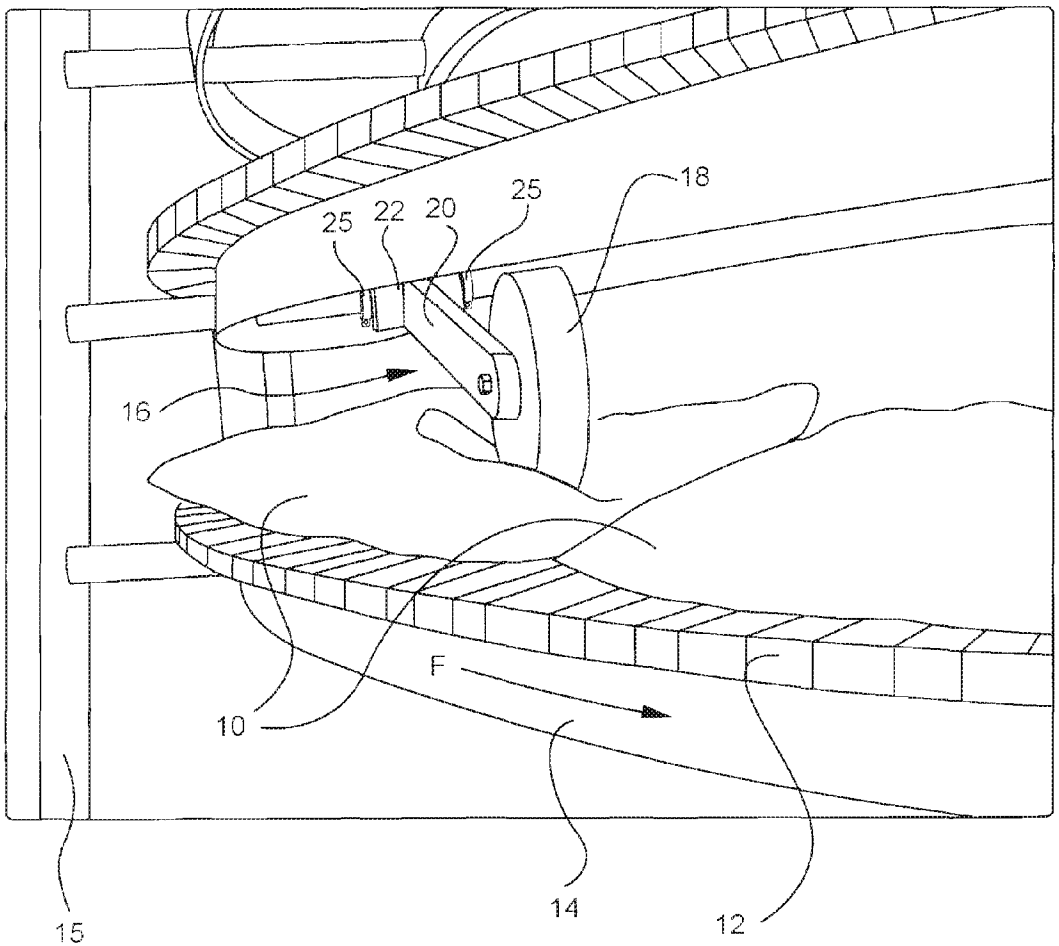
FIG. 3 is still another perspective view showing the pouched product in contact with the agitator of FIG. 1.

Referring to FIGS. 1-3, a pouch 10, containing a food product or another such liquid/viscous product, is transported along a conveyor belt 12 in the direction of arrow F. Conveyor belt 12 rides upon a pair of opposing tracks 14 supported by a frame 15. In the embodiment of FIGS. 1-3, belt 12 follows a generally circular path. In other embodiments, the belt may follow a generally straight path, or another selected direction.

Figure 4:
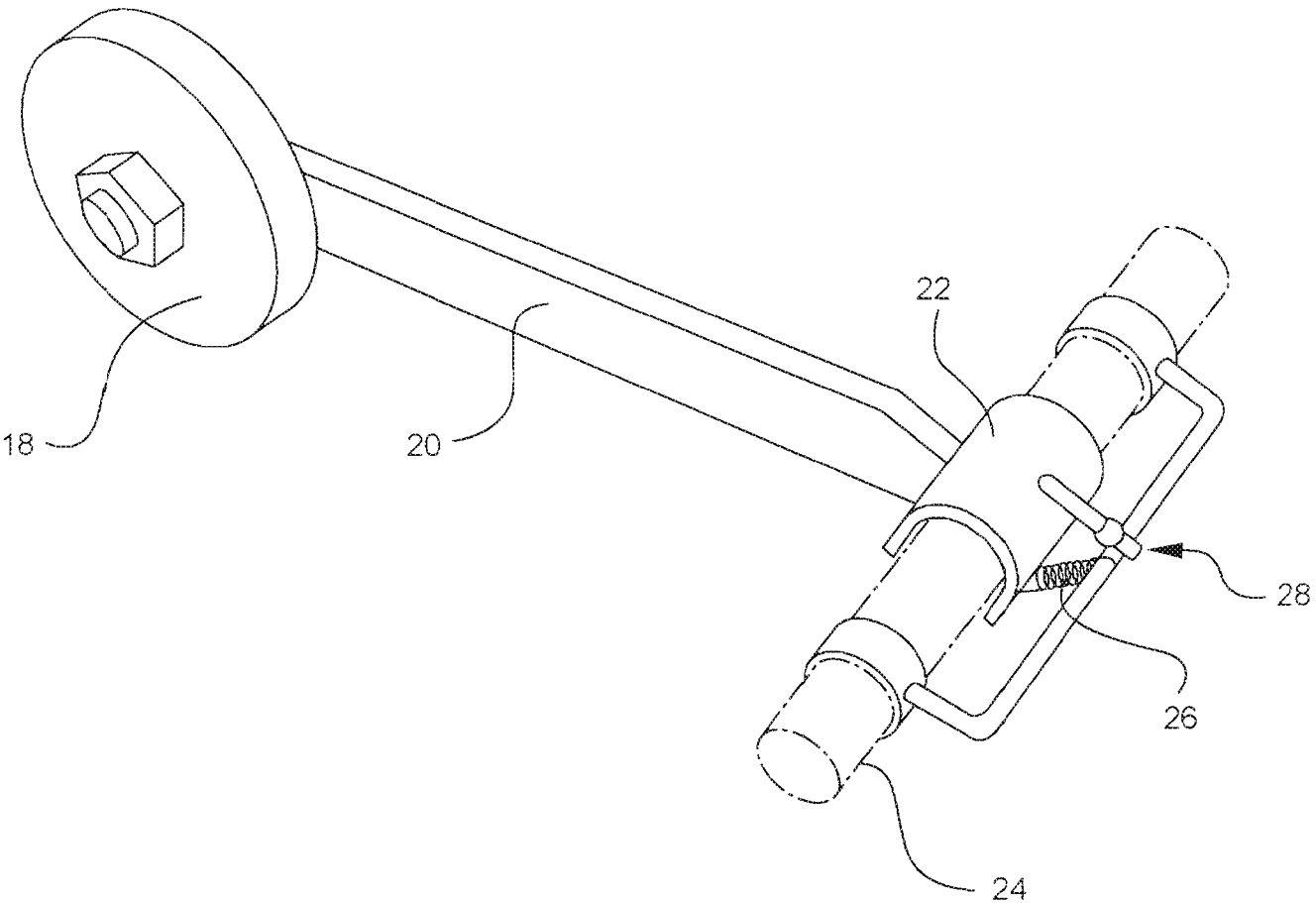
FIG. 4 is a detail of the arm which supports the agitator of the present invention.

The system of the present invention includes a plurality of agitation stations 16 positioned at pre-selected locations along the path of the conveyor belt. Each station preferably includes at least one agitator, e.g., a wheel 18 rotatably supported by an arm 20. In turn, arm 20 is pivotally coupled to the frame by, for example, a C-shaped coupler 22 (best shown in FIG. 4).

In one preferred embodiment, coupler 22 is coupled to a rod 24 extending transverse to and supporting tracks 14 (see FIG. 2). In turn, rod 24 is supported by the posts of frame 15. Hardware 25 may be used to locate coupler 22 at a particular position along rod 24. Of course, it is contemplated herein that arm 20 can be pivotally connected to any suitable portion of frame 15. It is also contemplated that coupler 22 can take various forms including a design wherein the coupler has a width approximately equal to the distance between tracks 14. Coupler 22 may include an interior bearing surface to facilitate pivoting about rod 24, or may be sized to receive a separately-formed bearing. Finally, it is contemplated herein that coupler 22 may be fixedly secured to rod 24, and that a pivoting joint be provided between the end of the arm and the coupler.

Those skilled in the art will appreciate that conveyor belt frames commonly employ such horizontally-extending rods to support the tracks on which the belt travels. It has been discovered herein that these rods (which are generally accessible even in existing systems) can be used to mount the mentioned arm/agitator, thereby allowing existing systems to be readily modified. More to the point, the design of coupler 22 allows the arm to be pivotally coupled to the existing rod without the need to disassemble the existing apparatus.

In operation, pouch 10 travel along conveyor belt 12 and may be subjected to heat and/or cold water spray, cold air or other cooling techniques. As it approaches agitation station 16, the leading end of the pouch contacts wheel 18. The movement of the conveyor belt forces pouch 10 under wheel 18, thus causing arm 20 to pivot about rod 24 whereby wheel 18 is moved away from the surface of conveyor belt 12. As pouch 10 continues to move along conveyor belt 12, wheel 18 rolls along the length of pouch 10. In one preferred embodiment, as shown in FIGS. 1-3, the wheel is positioned to roll along the approximate center of pouch 10.

Those skilled in the art will appreciate that wheel 18 will agitate the product contained within the pouch, thereby mixing the product in the center of the pouch (which remains at a higher temperature) with the product near the surfaces of the pouch (which has been cooled) or vice versa depending on whether the product contained in the pouch is being heated or cooled. This mixing is accomplished without the need to "flip" or otherwise subject the pouch to unnecessary stress which can puncture and/or otherwise weaken the bag, which may wrinkle the bag and/or which may mar the printing on the bag. This mixing may also be desired in other applications which do not necessarily involve heat transfer.

Wheel 18 may be weighted to apply a sufficient downward force or, alternatively, agitation station 16 may include a biasing means (e.g., a spring 26) which urges wheel 18 toward the upper surface of conveyor belt 12. Because arm 20 is pivotably mounted on rod 24, wheel 18 is allowed to travel a distance D in a direction away from and perpendicular to the surface of the conveyor belt. This distance can be pre-selected based upon the size and configuration of pouch 10. More particularly, station 16 may include an adjusting mechanism 28 which allows the operator to select the degree to which arm 20 can pivot about rod 24. Adjusting mechanism 28 may also include means for adjusting the bias of the spring (if any) applied to arm 20 whereby the force required to move wheel 18 away from the surface of conveyor belt 12 can be increased or decreased as desired.

It is contemplated herein that each agitation station will include at least one agitator for contacting the pouch and agitating the product contained therein. This agitator may include a single wheel, as shown in FIGS. 1-3, multiple wheels positioned side-by-side (for wider conveyor belts), or other geometrically-shaped objects.

Figure 5:
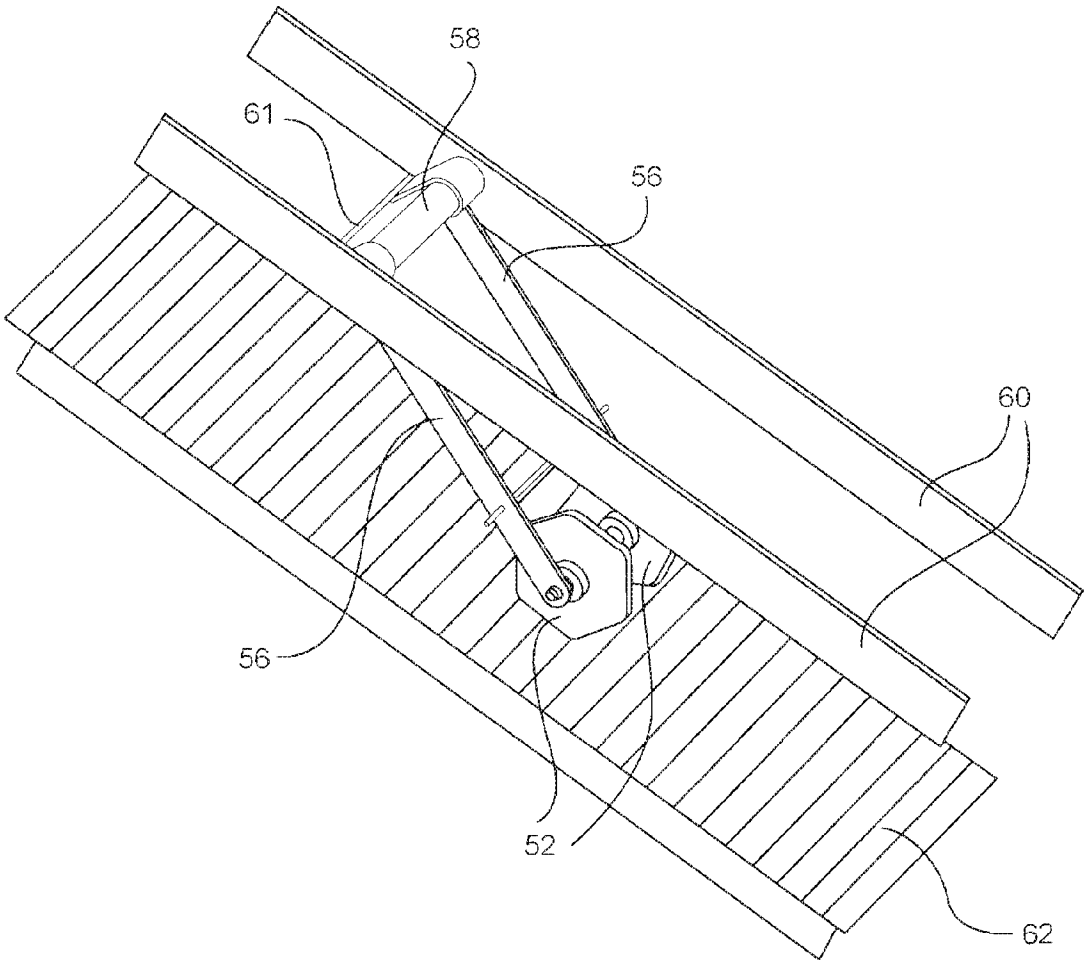
FIG. 5 is a perspective view of an alternative embodiment of the present invention.
Figure 6:
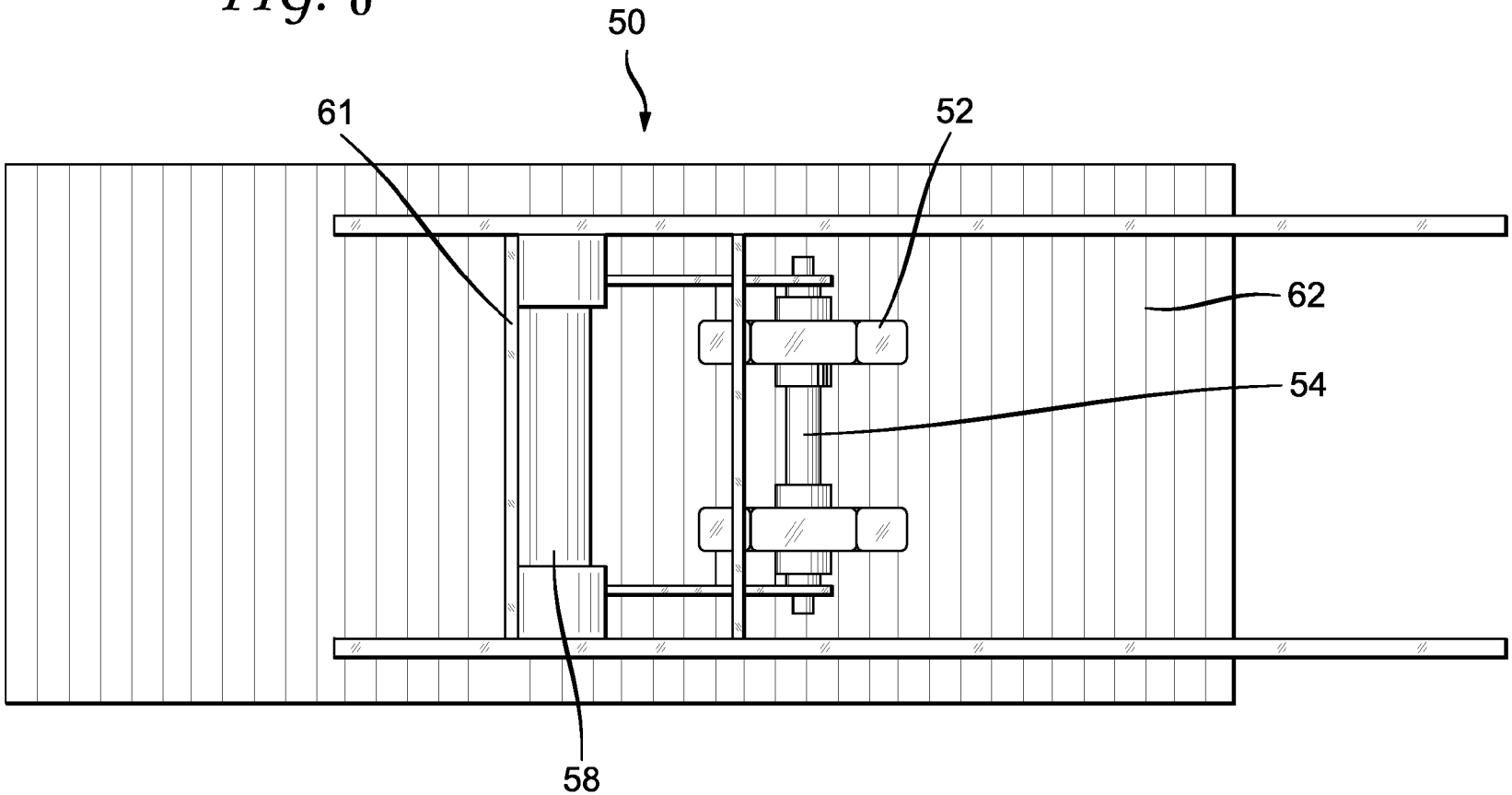
FIG. 6 is another perspective view of the alternative embodiment of FIG. 5.

For example, an alternative agitation station 50 is shown in FIGS. 5-6. In this embodiment, agitation station 50 includes a pair of agitators 52 rotatably supported on a shaft 54. Agitators 52 may be formed in the shape of a hexagon, which may increase the agitation of the product contained in the pouch because of the irregular geometry of the members. In the configuration shown in FIGS. 5-6, station 50 includes a pair of arms 56, both of which are pivotally supported by a rod 58, which extends through and supports tracks 60. An adjusting mechanism 61 allows the operator to control the degree to which arms 56 can pivot about rod 58 and/or to adjust the biasing (if any) of agitator 52 towards conveyor belt 62.

In operation, a pouch traveling along conveyor belt 62 will simultaneously contact agitators 52, both of which will roll along the length of the bag as the bag travels therepast. The use of multiple agitation members may be needed to increase the agitation of the product in the pouch, depending on such factors as the temperature of the product, the time available for heat transfer and/or the width of the pouch.

Although each of the embodiments described hereinabove utilizes an agitator which can "roll" along the length of the pouch, it is contemplated herein that the agitator may consist of a non-rolling device pivotably attached to the arm. Although such a device will not rotate as the pouch travels thereunder, the downwardly directed force that such member applies against the pouch will agitate the product contained therein. Moreover, the device may be configured such that it vibrates and/or shakes as the pouch travels thereunder, enhancing the ability of such device to agitate the product contained in the pouch.

It is also contemplated herein that the agitation system of the present invention may include agitators which contact the underside of a pouch. For example, a plurality of agitation wheels could be located between adjacent conveyor belts on particular systems. It is also contemplated that the agitators may be supported along the sides of the conveyor belt such that they pivot inwards/outwards to contact the sides of the pouch. It is further contemplated that the agitators may be supported directly above the point of contact with the pouch wherein the arm supporting the agitator may include telescoping portions which allow the wheel to travel in a direction perpendicular to the conveyor belt. Finally, it will be recognized by those skilled in the art that because the agitation system of the present invention facilitates the heat transfer process between the contents of the pouch and the exterior environment, the present system requires less energy and is therefore more energy efficient than known prior art systems.

It will be appreciated that the present invention has been described herein with reference to certain preferred or exemplary embodiments. The preferred or exemplary embodiments described herein may be modified, changed, added to or deviated from without departing from the intent, spirit and scope of the present invention and it is intended that all such additions, modifications, amendments and/or deviations be included in the scope of the following claims.

The invention claimed is:

1. A system for agitating a pouched product, comprising:

a) a frame;

b) a conveyor belt supported by said frame for transporting said pouched product, said conveyor belt defining a pouch pathway, said frame including at least one cylindrical rod positioned above and extending transverse to said pouch pathway; and c) at least one agitation station located along said conveyor belt for agitating said pouched product traveling therepast, said station including an agitator and an arm having first and second ends, said first end of said arm including a C-shaped coupler for removable engagement with said rod whereby said first end is pivotally secured to said frame, said agitator including a wheel rotatably secured to said second end of said arm, said arm being located to position said wheel adjacent said belt and within said pouch pathway whereby movement of said pouch through said agitation station causes said pouch to engage said wheel thereby causing said arm to pivot about said first end.

2. The system according to claim 1, wherein said wheel is circular.

3. The system according to claim 1, wherein said agitator is a multi-sided polygon.

4. The system according to claim 1, further comprising a second agitator, a second arm having first and second ends and a shaft connecting said second ends of said arms, said agitators being rotatably connected to said second ends of said arms via said shaft extending therebetween, said first end of said second arm being pivotally secured to said frame.

5. The system according to claim 1, wherein said conveyor belt includes an upper transporting surface defined by a pair of opposing side edges, and wherein said agitator is positioned over said upper surface.

6. The system according to claim 5, wherein said agitator is positioned between said opposing side edges in the substantial center thereof.

7. The system according to claim 1, further comprising hardware for locating said coupler along the length of said rod.

8. The system according to claim 7, further comprising an arm adjusting mechanism for controlling the degree of pivoting of said arm with respect to said rod.

9. The system according to claim 1, wherein said conveyor belt includes an upper surface and a lower surface, and wherein said agitator is biased towards said upper surface of said conveyor belt.

10. The system according to claim 9, wherein said agitation station further includes a spring for biasing said agitator towards said upper surface of said conveyor belt.

* * * * *